United States Patent [19]

Schminke et al.

[11] 3,957,462

[45] May 18, 1976

[54] IONIZING ELECTRODE COATED WITH PLASTICS MATERIAL

[75] Inventors: Heinz Schminke, Egelsbach; Willi Bätza, Offenbach, both of Germany

[73] Assignee: Metallgesellschaft Aktiengesellschaft, Frankfurt am Main, Germany

[22] Filed: June 5, 1975

[21] Appl. No.: 583,902

[30] Foreign Application Priority Data

June 7, 1974 Germany ..... 2427509

[52] U.S. Cl. ..... 55/2; 55/152; 427/185

[51] Int. Cl.[2] ..... B03C 3/41

[58] Field of Search ..... 55/112, 147, 152, 2; 427/27, 185, 195

[56] References Cited

UNITED STATES PATENTS

| | | | |
|---|---|---|---|
| 3,483,671 | 12/1969 | Wiemer | 55/152 |

FOREIGN PATENTS OR APPLICATIONS

| | | | |
|---|---|---|---|
| 1,596,929 | 7/1970 | France | 427/185 |
| 734,207 | 7/1955 | United Kingdom | 55/150 |
| 840,853 | 7/1960 | United Kingdom | 55/152 |

*Primary Examiner*—Bernard Nozick
*Attorney, Agent, or Firm*—Karl F. Ross; Herbert Dubno

[57] ABSTRACT

An ionizing electrode for the generation of a corona discharge in an electrostatic dust-collecting precipitator comprising an elongated metallic body provided with spaced-apart pointed tips, and a layer of nylon-11 material covering the body and having a thickness of 100 to 300 microns, preferably 150 to 250 microns. The electrostatic precipitator has an operating temperature of at most 140° and preferably less than 120°C.

7 Claims, 3 Drawing Figures

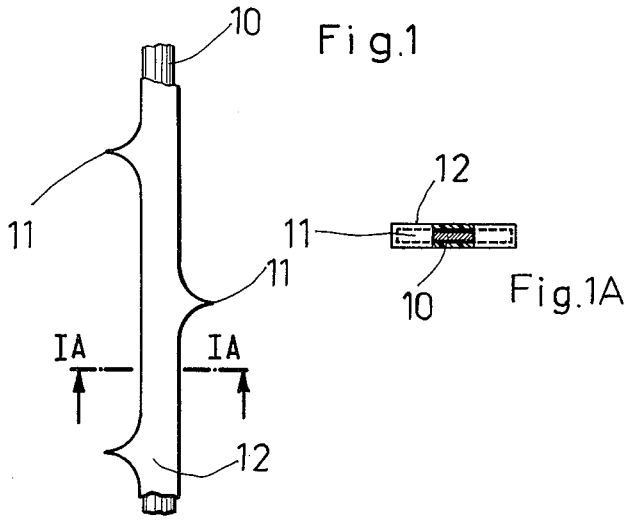
Fig.1
Fig.1A
Fig.2
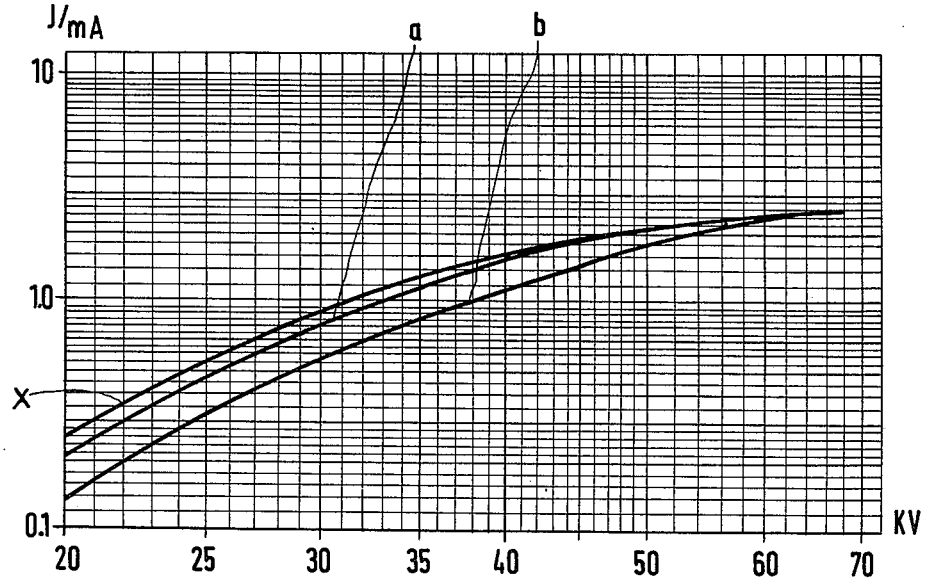

IONIZING ELECTRODE COATED WITH PLASTICS MATERIAL

FIELD OF THE INVENTION

This invention relates to an ionizing electrode which is coated with synthetic resin material and intended for use in dust-collecting electrostatic precipitators.

BACKGROUND OF THE INVENTION

It is known to provide ionizing electrodes with a conducting or insulating protective coating in order to prevent corrosion.

According to the German Pat. No. 368,519, insulating varnish or a coating of nonconducting enamel is applied to the ionizing or corona discharge electrodes of a dust-collecting electrostatic precipitator.

From the German Pat. No. 557,185 it is known to use an electrically conducting varnish, particularly a graphite-containing varnish, as a protective coating on the electrodes.

It is also known to coat corona discharge electrodes with varnish as well as with hard rubber or a phenol condensation product in such a manner that the edges of the corona wires are left by the protective coating.

These coatings are used to prevent corrosion mainly in wet-process electrostatic precipitators or in mist-collecting electrostatic precipitators. In most of such precipitators, deposited dust is rinsed from the corona discharge electrodes rather than being removed in that the electrodes are vibrated, shaken, or rapped. Rapping of such corona discharge electrodes involves the risk that the vibration of the wire may result in cracks in the relatively brittle protective coatings, and moisture diffusing into such cracks and corrosive gaseous constituents can migrate under the protective layers so that the metallic parts of the corona discharge electrodes are corroded and break.

Another disadvantage of such layers on ionizing electrodes, particularly of electrically insulating layers, resides in that they suppress the corona discharge so that the resulting ionization is reduced.

OBJECTS OF THE INVENTION

It is an object of the invention to overcome the disadvantage of the prior art and to provide a corona discharge electrode wich is provided with a synthetic resin coating that is sufficiently elastic to withstand vibration of the wires without damage, particularly without a formation of cracks in the plastics material coating, and to prevent the disadvantages involved in an accelerated corrosion, particularly in corrosion due to stress and vibration, in the metallic corona wires.

It is also an object of the invention to apply a plastics material layer in such a manner that the current-voltage characteristic curve of the coated electrode is only slightly changed compared to that of the metal ionizing electrode, which may consist, e.g., of a corona discharge wire or a corona discharge strip.

SUMMARY OF THE INVENTION

To accomplish this object, the ionizing electrode is provided in known manner with pointed tips and a synthetic resin coating of nylon-11 (polyamide-11) in a thickness of 100–300 microns, preferably 150–250 microns, is used in the dust-collecting electrostatic precipitator in a unit in which the operating temperatures are not in excess of 140°C, preferably not in excess of 120°C.

It has surprisingly been found that the nylon-11, which is known under the trade name "Rilsan", can be used to special advantage in accomplishing the objects defined above. Nylon-11 cannot be used at temperatures near its melting point, which is about 185°C.

On the other hand, nylon-11 can be used in dust-collecting electrostatic precipitators, e.g., in a cement-making plant, in which furnaces and mills are succeeded by dust-collecting electrostatic precipitators.

The hot exhaust gases from the furnaces and mills are cooled in most cases by the injection and evaporation of water. As a result, the gas temperature is lowered and the moisture content of the gas is increased so that the dust can be collected under favorable conditions in the dust-collecting electrostatic precipitator (see "Zement Kalk-Gips", 23, 1970, No. 3, pages 106–112).

These dust-collecting electrostatic precipitators operate under dry conditions and in most cases have ionizing electrodes which consist of wires or strips provided with pointed tips, which are points of preferential ionization with a high current density.

In most cases, the ionizing electrodes are held taut in so-called corona discharge frames, in which the electrodes are parallel and are positioned one beside the other. The frames provided with ionizing electrodes must be periodically rapped or shaken in order to prevent a deposition of dust or to remove such deposits, which would suppress the ionizing current.

The electrodes are held in the frames under tensile stress, and are subjected to superimposed stresses due to vibration when the electrode is rapped. In the plants described above, there is also a fluid which is more or less agressive, depending on operating conditions. Under these circumstances, stress corrosion and vibration corrosion soon result in a fracture of electrodes. Such fractures are known to occur although the actual mechanical stress is below the fatigue limit so that the stresses which arise can be taken up by the electrodes satisfactorily in an inert environment.

After long-time rapping tests, a surface of layers of nylon-11 exhibits no hairline cracks or other cracks through which fluids could migrate below the layer and corrode the ionizing electrodes. The layer was elastic and smooth and hardly accumulated dust deposits.

It has been found sufficient to provide layers in a thickness of 100–300 microns, particularly electrostatically sprayed layers of nylon-11 in a thickness of up to 150 mm, and layers of nylon-11 formed in a thickness of 250 microns by a fluidized-bed sintering process, in which a powder is applied in a frit and is subsequently fused by a heat treatment.

During the operation of a dust-collecting electrostatic precipitator provided with the electrodes according to the invention, the electrical conditions, i.e., the current consumption at the highest voltages (operating voltage range of a dust-collecting electrostatic precipitator) are virtually the same as with metallic electrodes.

The nylon-11 layers which are applied are inherently very thin at the pointed tips of the electrode and melt off during operation as a result of the heat which is locally produced by the corona discharge. For this reason the metal need not be exposed at the tips by a special treatment.

The coated ionizing electrode exhibits substantially the same electrical behavior as a metallic corona discharge electrode and produces a high-intensity corona discharge at the pointed tips.

It has been observed that there are no additional migrating corona discharge points between the pointed tips of a coated ionizing electrodes whereas such migrating corona discharge points often occur on metallic electrodes. This has the advantage that the dust deposits which are opposite to the respective glow discharge points of the corona discharge are retained on the collecting electrode. By contrast a migration of corona glow discharge points on a metallic corona discharge electrode often causes the gas flowing in contact with the collecting electrode to entrain dust from the surface of the collecting electrode. Such an entraining of dust has not been observed where the electrode according to the invention was used.

BRIEF DESCRIPTION OF THE DRAWINGS

The invention will be described more in detail and by way of example with reference to the accompanying drawing, in which:

FIG. 1 is an elevational view of a corona discharge ionizing electrode which is provided with pointed tips and coated with nylon-11 material;

FIG. 1A is a section taken along line IA—IA of FIG. 1; and

FIG. 2 shows the current-voltage characteristic curves of ionizing electrodes a, b according to FIG. 1, which are respectively coated with synthetic-resin material, and of uncoated ionizing electrodes (curve *x*).

SPECIFIC DESCRIPTION AND EXAMPLE

FIG. 1 shows a portion of an ionizing electrode 10 which is provided with pointed tips 11. The electrode consists of a strip provided with struck-out tips for the corona discharge. Sets of parallel electrodes of this kind are normally held taut in corona discharge frames and arranged between the collecting electrodes of a gas channel of a dust-collecting electrostatic precipitator. One metallic ionizing electrode of the kind was electrostatically coated with a layer 12 of nylon-11 (Rilsan) in a thickness of 150 microns. Another electrode was provided with a layer of nylon-11 by a fluidized-bed sintering process in a thickness of 250 microns.

In a test set-up, the three ionizing electrodes were tested between collecting electrodes to determine the current-voltage characteristics.

FIG. 2 shows the results. The ionizing electrodes *a* and *b* had been provided with nylon-11 layers in a thickness of 150 microns and 250 microns, respectively. It was surprisingly found that at higher voltages, in the operating voltage range of a dust-collecting electrostatic precipitators, the differences were so small that the characteristic curves virtually coincided with the current-voltage characteristic curve *x* of the metallic corona discharge.

We claim:

1. An ionizing electrode for the generation of a corona discharge in an electrostatic dust-collecting precipitator, comprising an elongated metallic body provided with spaced-apart pointed tips, and a layer of nylon-11 material covering said body and having a thickness of 100 to 300 microns.

2. The electrode defined in claim 1 wherein said thickness is substantially 150 to 250 microns.

3. The electrode defined in claim 2 wherein said body is a flattened strip.

4. The electrode defined in claim 2 wherein said body is a rod.

5. The electrode defined in claim 2 wherein said electrostatic precipitator has an operating temperature of at most 140°C.

6. The electrode defined in claim 5 wherein said temperature is less than 120°C.

7. A method of making an ionizing electrode for the generation of a corona discharge in an electrostatic dust collecting precipitator comprising the steps of coating an elongated metal body provided with spaced-apart pointed tips with nylon-11 and fusing the same into a layer having a thickness of 100 to 300 microns, said layer covering said body and said tips; mounting said body in said precipitator and operating same at a temperature of at most 140°C; and effecting a corona discharge at said tips to remove said layer therefrom.

* * * * *